US007714786B2

(12) United States Patent
Chen et al.

(10) Patent No.: US 7,714,786 B2
(45) Date of Patent: May 11, 2010

(54) ANTENNA DEVICE

(75) Inventors: Min-Che Chen, Tao Yuan (TW); Kuo-Cheng Chen, Tao Yuan (TW); Ching-Sung Wang, Tao Yuan (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 11/969,227

(22) Filed: Jan. 4, 2008

(65) Prior Publication Data

US 2009/0135067 A1 May 28, 2009

(30) Foreign Application Priority Data

Nov. 22, 2007 (TW) ..... 96144308 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/845–849, 343/700 MS, 702
See application file for complete search history.

(56) References Cited

U.S. PATENT DOCUMENTS 6,239,765 B1 5/2001 Johnson et al.
2003/0174092 A1 9/2003 Sullivan et al.
2004/0066334 A1 4/2004 Fang et al.
2004/0070548 A1* 4/2004 Cake ..... 343/803
2004/0140938 A1* 7/2004 Kadambi et al. ..... 343/702
2004/0169606 A1* 9/2004 Sato et al. ..... 343/702
2005/0093752 A1 5/2005 Cheng et al.
2006/0250309 A1 11/2006 Fang et al.

FOREIGN PATENT DOCUMENTS

EP 1703586 9/2006

* cited by examiner

*Primary Examiner*—Vibol Tan
*Assistant Examiner*—Jany Tran
(74) *Attorney, Agent, or Firm*—Jianq Chyun IP Office

(57) ABSTRACT

An antenna device including a ground plane, a circuit board, an antenna, and a conductive wire is provided. The circuit board includes a signal feed point, and the antenna includes a radiation portion and a feed portion extending externally from the radiation portion. The feed portion is electrically connected to the signal feed point, and the conductive wire is disposed on the circuit board and electrically connected to the ground plane and the signal feed point. The conductive wire is, for example, a printed trace formed on the circuit board.

25 Claims, 3 Drawing Sheets

ANTENNA DEVICE

CROSS-REFERENCE TO RELATED APPLICATION

This application claims the priority benefit of Taiwan application serial no. 96144308, filed on Nov. 22, 2007. The entirely of the above-mentioned patent application is hereby incorporated by reference herein and made a part of this specification.

BACKGROUND OF THE INVENTION

1. Field of the Invention

The present invention generally relates to an antenna device, in particular, to a planar inverted F antenna (PIFA) device applied in a global positioning system (GPS).

2. Description of Related Art

Nowadays, communities of people have growing demands for wireless communication, and various types of wireless communication devices have been developed, including smart phones, multimedia players, PDAs, and satellite navigators using the global positioning system (GPS). Electronic devices provided with the wireless transmission function are improved complying with the design notion of "thin, light, short, and small", so as to meet the requirements of daily use electronic products.

The conventional GPS antenna applied in the wireless device is usually a chip antenna, a patch antenna, or a planar inverted F antenna. Among them, the chip antenna has a higher price and cost since the manufacturing process of the chip is more complicated than other metal antennas. The patch antenna or the planar inverted F antenna requires a large area, and occupies an effective radiation area on the circuit board, thus greatly lowering the space utilization of the circuit board. In the planar inverted F antenna, the metal radiator thereof is spaced by a suitable distance from the circuit board, and the energy is resonated between the antenna and the circuit board and is radiated in the form of a linearly polarized wave. The architecture of the patch antenna mainly is the chip antenna, and includes a signal feed point, utilizes a ground plane as an energy resonance surface, and radiates in the form of a circularly polarized wave. This antenna has a higher directivity, but requires a larger antenna area and a higher price, and is not applicable to the mobile mode of mobile phones. In addition, the conventional GPS antenna usually contacts the signal feed point or short pad through a pogo-pin or a leaf spring, thus resulting in the difficulties in controlling the resistance.

FIG. 1 shows a structure of a conventional planar inverted F antenna. The planar inverted F antenna 3 includes a planar radiator 31, a feed portion 32, and a ground portion 33. The radiator 31 is disposed above the circuit board 4, and the ground portion 33 extends downwardly from the radiator 31 to electrically connect the ground plane 42 on the circuit board 4 through a ground leaf spring (not shown). And, the feed portion 32 extends downwardly from a position approximately in the middle of the radiator 31 to electrically connect the signal feed point 41. Therefore, in the conventional planar inverted F antenna 3, the signal feed point 41 and the ground plane 42 of the circuit board 4 are not connected.

In the above conventional art, an extending space for the ground portion 33 of the antenna 3 must be provided on the circuit board 4, so as to achieve a better antenna performance. However, under the requirements of improved functions and miniaturization of the hand-held electronic devices, it is difficult to provide extra room for the planar inverted F antenna to ground downwardly. And, as for the GPS antenna, when the planar inverted F antenna is not grounded, even if the size of the radiator is greatly increased, the required frequency cannot be achieved, which not only causes a higher cost, but also goes against the requirements of the miniaturization of the electronic devices.

SUMMARY OF THE INVENTION

Accordingly, the present invention is directed to an antenna device, which includes a ground plane, a circuit board, an antenna, and a conductive wire. The circuit board includes a signal feed point, and the antenna includes a radiation portion and a feed portion extending externally from the radiation portion. The feed portion is electrically connected to the signal feed point, and the conductive wire is disposed on the circuit board and electrically connected to the ground plane and the signal feed point. The ground plane may be a part of the circuit board or separate from the circuit board.

According to an embodiment of the present invention, the conductive wire is, for example, a printed trace formed on the circuit board. The length of the conductive wire is preferably between 2 mm and 5 mm, and the width of the conductive wire is preferably between 0.25 mm and 0.5 mm. Moreover, the distance between the radiation portion and the ground plane of the antenna is at least 2 mm.

In the antenna device according to an embodiment of the present invention, the radiation portion of the antenna forms a plane substantially parallel to the circuit board or substantially perpendicular to the circuit board.

In the antenna device according to an embodiment of the present invention, the antenna is fixed by insert-molding to an antenna pedestal, and mounted on the circuit board by a surface mounting technology (SMT).

Moreover, the antenna device of the present invention may be applied not only in a GPS antenna, but also in a wireless LAN (WiFi) antenna or a Bluetooth communication antenna.

According to another embodiment of the present invention, another antenna device is provided. The antenna device includes a ground plane, a signal feed point, an antenna, and a conductive wire. The antenna includes a radiation portion and a feed portion which extends from the radiation portion and is electrically connected to the signal feed point. The conductive wire is electrically connected to the ground plane and the signal feed point.

In an embodiment of the present invention, the radiation portion has a plane and the plane of the radiation portion is either substantially perpendicular to the ground plane or substantially parallel to the ground plane.

In the present invention, since the printed trace formed on the circuit board is electrically connected to the signal feed point and the ground plane on the circuit board, the ground effect of the conventional inverted F antenna can also be achieved without disposing an additional ground portion to ground the antenna. Compared with the conventional art, the ground portion of the antenna is not required by the antenna device of the present invention, and thus the hardware space for the electronic device is effectively reduced, thereby meeting the requirements of lower cost and miniaturization.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
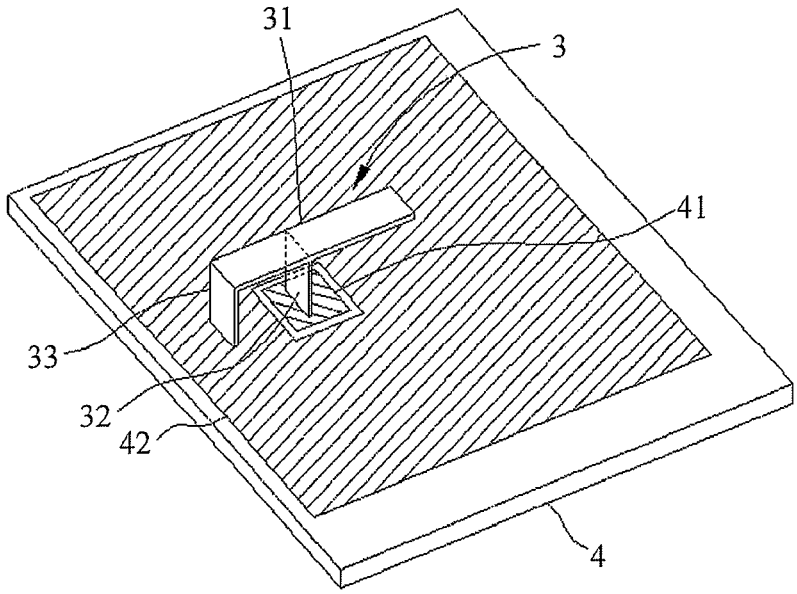
FIG. 1 (PRIOR ART)
FIG. 1 is a schematic view of a conventional planar inverted F antenna.

Reference will now be made in detail to the present embodiments of the invention, examples of which are illustrated in the accompanying drawings. Wherever possible, the same reference numbers are used in the drawings and the description to refer to the same or like parts.

Figure 2:
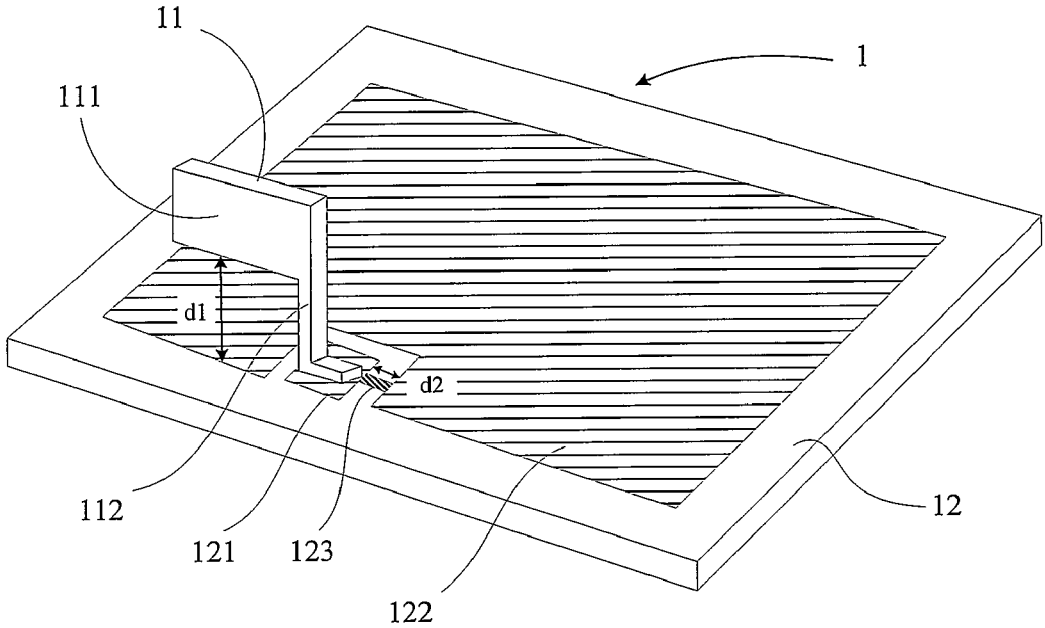
FIG. 2 is a schematic view of an antenna device according to an embodiment of the present invention.

Referring to FIG. 2, the antenna device 1 in an embodiment of the present invention is an inverted F antenna applied in GPS. The antenna device 1 includes an antenna 11 disposed on a printed circuit board 12. A radiation portion 111 of the antenna 11 is spaced by a suitable distance from the printed circuit board 12, and a feed portion 112 of the antenna 11 extends downwardly from the radiation portion 111 to electrically connect a signal feed point 121 on the printed circuit board 12.

In this embodiment, a conductive wire 123 is disposed on the printed circuit board 12. The conductive wire 123 is, for example, a printed trace directly formed on the printed circuit board 12, and extending externally from the signal feed point 121 to electrically connect a ground plane 122 on the printed circuit board 12. The ground plane 122 is, for example, a short pad.

In order to achieve better performance of the antenna device 1, the distance d1 between the radiation portion 111 of the antenna 11 and the ground plane of the printed circuit board 12 is at least 2 mm. Moreover, the length d2 of the conductive wire 123 formed by the printed trace is preferably between 2 mm and 5 mm, and the width of the conductive wire 123 is preferably between 0.25 mm and 0.5 mm. As far as the length of the conductive wire 123 is concerned, if the length d2 of the conductive wire 123 is less than 2 mm, the signal energy on the antenna 11 is directly conducted into the ground plane 122. If the length d2 of the conductive wire 123 is greater than 5 mm, the loss of the signal energy on the antenna 11 may occur, and the volume of the antenna is increased, which further influences the performance of the antenna device 1.

Figure 5:
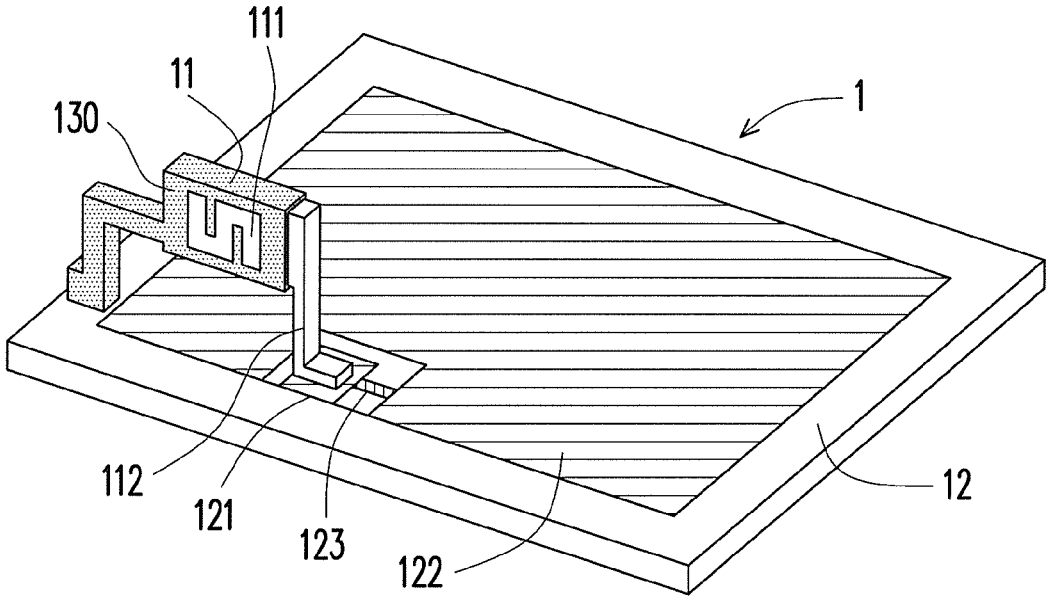
FIG. 5 is a schematic view of an antenna device with an antenna pedestal according to another embodiment of the present invention.
Figure 6:
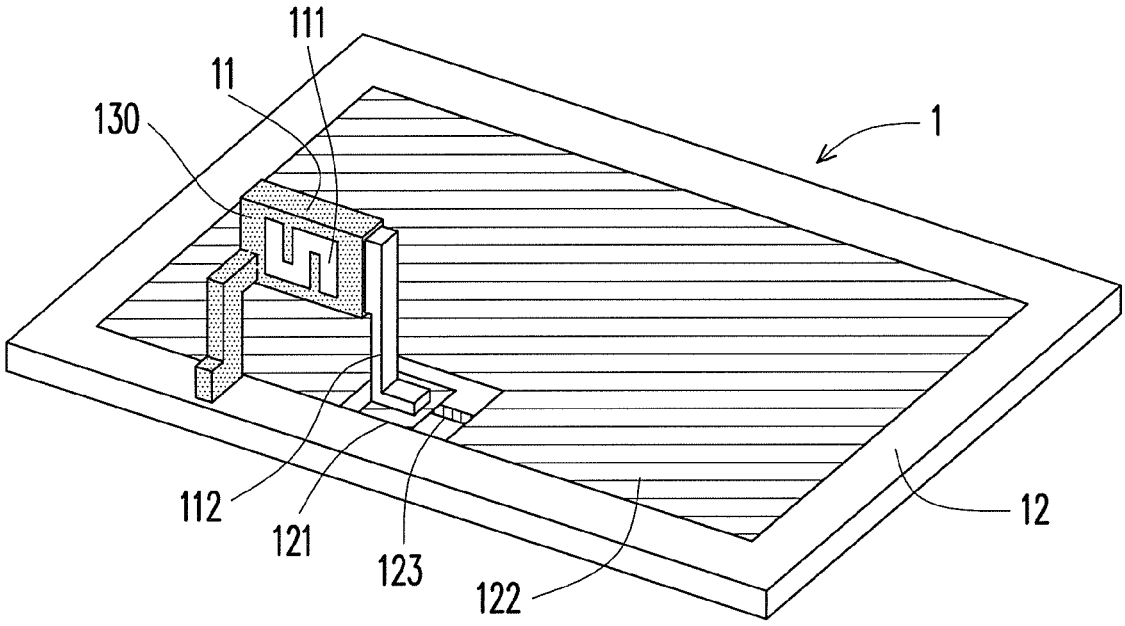
FIG. 6 is a schematic view of an antenna device with an antenna pedestal according to the other embodiment of the present invention.

The antenna device 1 in this embodiment is an inverted F antenna for GPS. The radiation portion 111 of the antenna 11 forms a plane substantially perpendicular to the printed circuit board 12. In this embodiment, in order to achieve a better effect of fixing the antenna 11 on the printed circuit board 12, the feed portion 112 of the antenna 11 may be mounted on the signal feed point 121 of the circuit board 12 by a surface mounting technology (SMT), and meanwhile, may be embedded by insert-molding into an antenna pedestal 130 (as shown in FIG. 5 and FIG. 6) made of a plastic. Then one end of the antenna pedestal 130 is fixed on the printed circuit board 12 by heat stacking. Moreover, in the above embodiment, the radiation portion 111 of the new-type antenna 11 of the present invention is located at the upper left edge of the printed circuit board 12 of a hand-held antenna device 1 (e.g., a smart phone), and is 21 mm×3 mm×5 mm in volume, which is much smaller than that of the common patch antenna (15 mm×15 mm×5 mm in volume) applied in the GPS. Moreover, the material of antenna 11 of the antenna device 1 in this embodiment is, for example, phosphor bronze, which has a more stable characteristic and lower cost than the material of the conventional chip antenna used in the GPS.

Figure 3:
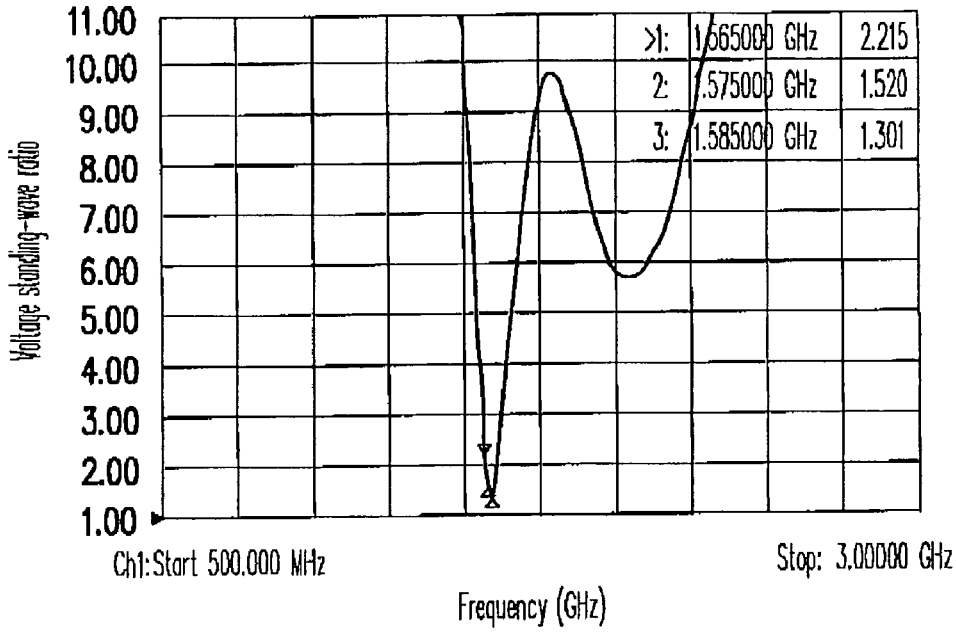
FIG. 3 is a diagram showing an actual measurement of a voltage standing-wave ratio of the antenna device according to an embodiment of the present invention when resonated at 1575.42 MHz.

Referring to FIG. 3, for the performance and the actual operating frequency range of the antenna, it is known that the operating frequency range of the GPS is 1575.42±2 MHz. FIG. 3 is a diagram showing an actual measurement of the voltage standing-wave ratio of the antenna device 1 in the above embodiment when resonated at 1575.42 MHz. It can be seen from FIG. 3 that, in the actual measurement, the center frequency of the antenna device 1 is 1575.42 MHz. Therefore, the actual measurement data in the above embodiment is in consistent with the operating frequency range of the GPS.

Figure 4:
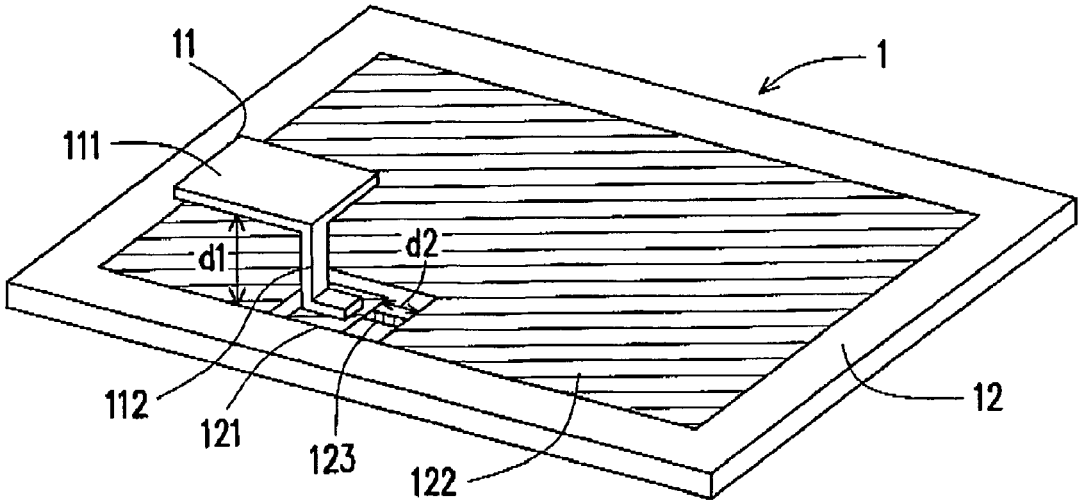
FIG. 4 is a schematic view of an antenna device according to another embodiment of the present invention.

FIG. 4 shows an antenna device 1 according to another embodiment of the present invention. In this embodiment, the antenna device 1 is also applied in an inverted F antenna of the GPS. The antenna device 1 includes an antenna 11 disposed on a printed circuit board 12. A radiation portion 111 of the antenna 11 is spaced by a suitable distance from the printed circuit board 12, and a feed portion 112 of the antenna 11 extends downwardly from the radiation portion 111 to electrically connect a signal feed point 121 of the printed circuit board 12.

A conductive wire 123 is disposed on the printed circuit board 12. The conductive wire 123 is, for example, a printed trace directly formed on the printed circuit board 12, and extending externally from the signal feed point 121 to electrically connect a ground plane 122 on the printed circuit board 12. The ground plane 122 is, for example, a short pad.

The difference between this embodiment and the above embodiment lies in that the plane formed by the radiation portion 111 of the antenna 11 in this embodiment is substantially parallel to the printed circuit board. Other conditions and methods in the two embodiments are substantially the same, and will not be repeated herein.

In the above embodiment, the antenna device of the present invention is the GPS antenna. However, the antenna device of the present invention may also be applied in a wireless LAN (WiFi) antenna or a Bluetooth communication antenna. The antenna device of the present invention may be, but not limited to, a PDA mobile phone, a smart phone, a satellite navigator, or a PDA.

In the present invention, since the printed trace formed on the circuit board is electrically connected to the signal feed point and the ground plane on the circuit board, the ground effect of the conventional inverted F antenna can also be achieved without disposing an additional ground portion to ground the antenna. Compared with the conventional art, the ground portion of the antenna is not disposed in the antenna device of the present invention, and thus the hardware space for electronic device is effectively reduced, thereby meeting the requirements on low cost and miniaturization.

Moreover, the antenna body is mounted on the circuit board by a surface mounting technology (SMT), and meanwhile, the antenna body is embedded by insert-molding into the antenna pedestal made of a plastic. Then, one end of the antenna pedestal is fixed on the printed circuit board by heat stacking. Thus, different from the conventional GPS antenna which contacts the signal feed point or short pad through the pogo-pin or leaf spring, in the present invention, the members can be fixed more stably, and a better resistance control can be achieved.

Although the ground plane is included in the circuit board in the above embodiments, the ground plane may be a standalone component separate from the circuit board in some other embodiments of the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna device, comprising:

a ground plane;

a circuit board, comprising a signal feed point;

an antenna, comprising a radiation portion and a feed portion extending from the radiation portion and electrically connected to the signal feed point; and a conductive wire, electrically connected to the ground plane and the signal feed point, wherein the antenna is grounded through the signal feed point and the conductive wire.

2. The antenna device according to claim 1, wherein the conductive wire includes a printed trace disposed on the circuit board.

3. The antenna device according to claim 2, wherein a length of the conductive wire is between 2 mm and 5 mm, and a width of the conductive wire is between 0.25 mm and 0.5 mm.

4. The antenna device according to claim 1, wherein a distance between the radiation portion and the ground plane is at least 2 mm.

5. The antenna device according to claim 1, wherein the radiation portion has a plane.

6. The antenna device according to claim 5, wherein the plane of the radiation portion is substantially perpendicular to the circuit board.

7. The antenna device according to claim 5, wherein the plane of the radiation portion is substantially parallel to the circuit board.

8. The antenna device according to claim 1, wherein the antenna is mounted on the circuit board by a surface mounting technology (SMT).

9. The antenna device according to claim 1, further comprising an antenna pedestal, wherein the antenna is fixed on the antenna pedestal.

10. The antenna device according to claim 9, wherein a material of the antenna pedestal is plastic, and the antenna is fixed by insert-molding to the antenna pedestal.

11. The antenna device according to claim 10, wherein the antenna is mounted on the circuit board by a surface mounting technology (SMT).

12. The antenna device according to claim 1, wherein the antenna device is a global positioning system (GPS) antenna, a wireless LAN (WiFi) antenna, or a Bluetooth antenna.

13. The antenna device according to claim 1, wherein the circuit board comprises the ground plane.

14. An antenna device, comprising:

a ground plane;

a signal feed point;

an antenna, comprising a radiation portion and a feed portion extending from the radiation portion and electrically connected to the signal feed point; and a conductive wire, electrically connected to the ground plane and the signal feed point, wherein the antenna is grounded through the signal feed point and the conductive wire.

15. The antenna device according to claim 14, further comprising a circuit board, wherein the conductive wire includes a printed trace disposed on the circuit board.

16. The antenna device according to claim 15, wherein a length of the conductive wire is between 2 mm and 5 mm, and a width of the conductive wire is between 0.25 mm and 0.5 mm.

17. The antenna device according to claim 14, wherein a distance between the radiation portion and the ground plane is at least 2 mm.

18. The antenna device according to claim 14, wherein the radiation portion has a plane.

19. The antenna device according to claim 18, wherein the plane of the radiation portion is substantially perpendicular to the ground plane.

20. The antenna device according to claim 18, wherein the plane of the radiation portion is substantially parallel to the ground plane.

21. The antenna device according to claim 14, further comprising a circuit board, wherein the antenna is mounted on the circuit board by a surface mounting technology (SMT).

22. The antenna device according to claim 14, further comprising an antenna pedestal, wherein the antenna is fixed on the antenna pedestal.

23. The antenna device according to claim 22, wherein a material of the antenna pedestal is plastic, and the antenna is fixed by insert-molding to the antenna pedestal.

24. The antenna device according to claim 23, further comprising a circuit board, wherein the antenna is mounted on the circuit board by a surface mounting technology (SMT).

25. The antenna device according to claim 14, further comprising a circuit board, wherein the circuit board comprises the ground plane.

* * * * *